US006631619B2

(12) United States Patent
Nonaka et al.

(10) Patent No.: US 6,631,619 B2
(45) Date of Patent: Oct. 14, 2003

(54) AIR-CONDITIONING APPARATUS

(75) Inventors: Masayuki Nonaka, Nagareyama (JP); Hidenori Yokoyama, Oohira (JP); Hiroo Nakamura, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/096,802

(22) Filed: Mar. 14, 2002

(65) Prior Publication Data

US 2003/0019944 A1 Jan. 30, 2003

(30) Foreign Application Priority Data

Jul. 26, 2001 (JP) ..... 2001-225315

(51) Int. Cl.[7] ..... F25B 49/00; G05D 15/00

(52) U.S. Cl. ..... 62/126; 236/51; 700/276

(58) Field of Search ..... 236/51, 94; 62/175, 62/229, 126; 700/276

(56) References Cited

U.S. PATENT DOCUMENTS 6,026,652 A * 2/2000 Wada ..... 62/175
2002/0055977 A1 * 5/2002 Nishi ..... 709/208
2002/0180581 A1 * 12/2002 Kamiwada et al. ..... 340/5.2

* cited by examiner

*Primary Examiner*—William Wayner
(74) *Attorney, Agent, or Firm*—Antonelli, Terry, Stout & Kraus, LLP

(57) ABSTRACT

An air-conditioning apparatus, being able to download operation control information through a network, wherein a remote controller of the air-conditioner is structured, so that it can indicate the operation information download, and is provided a function of indicating an operation under the operation mode upon the basis of that operation information to the air-conditioner. And also, a function is provided for inhibiting transmission of the information between the network, thereby obtaining an improvement on operability after downloading, as well as, an improvement on operability during the download operation, and also protection from erroneous operation(s) caused due to being connected to the network.

9 Claims, 8 Drawing Sheets

FIG. 4

| DOWNLOAD INFORMATION NO. | OPERATION MODE | REMOTE CONTROLLER DISPLAY |
|---|---|---|
| 1 | SUPER RAPID HEATING | RAPID HEATING |
| 2 | SUPER STILL | SUPER STILL |
| 3 | NORTH COUNTRY HIGH HUMIDITY AREA | NORTH COUNTRY HIGH HUMIDITY |
| 4 | NORTH COUNTRY LOW HUMIDITY AREA | NORTH COUNTRY LOW HUMIDITY |
| 5 | MAX 15A | 15A |
| 6 | MAX 10A | 10A |
| 7 | AGED PERSON | AGED PERSON |
| 8 | SUPER ENERGY SAVING | SUPER ENERGY SAVING |
| 9 | EMPTY | – |
| 10 | EMPTY | – |
| 11 | EMPTY | – |
| 12 | EMPTY | – |

FIG. 7

| DOWNLOAD INF. NO. | OPERATION MODE | REMOTE CONTROLLER DISPLAY | MAX CURRENT (A) | COMPRESSOR PRE-BEAT TEMP.(℃) | INDOOR FAN ROTATION SPEED($min^{-1}$) | OUTDOOR FAN ROTATION SPEED($min^{-1}$) | COMPRESSOR ROTATION SPEED($min^{-1}$) | COMPRESSOR ACCELERATION RATE | DEFROST DECISION BEAT EXCHANGER TEMP.(℃) | DEFROST STOP DECISION BEAT EXCHANGER TEMP.(℃) |
|---|---|---|---|---|---|---|---|---|---|---|
| 1 | SUPER RAPID HEATING | RAPID HEATING | 20A | STANDARD+15 | STANDARD+200 | STANDARD+200 | STANDARD+500 | STANDARD×1.2 | STANDARD | STANDARD |
| 2 | SUPER STILL | STILL | 20A | STANDARD | STANDARD−200 | STANDARD−100 | STANDARD−100 | STANDARD | STANDARD | STANDARD |
| 3 | NORTH COUNTRY HIGH HUMIDITY AREA | NORTH COUNTRY HIGH HUMID | 20A | STANDARD+5 | STANDARD | STANDARD | STANDARD | STANDARD×1.1 | STANDARD+5 | STANDARD+5 |
| 4 | NORTH COUNTRY LOW HUMIDITY AREA | NORTH COUNTRY LOW HUMID | 20A | STANDARD+5 | STANDARD | STANDARD | STANDARD | STANDARD×1.1 | STANDARD | STANDARD |
| 5 | MAX15A | 15A | 15A | STANDARD | STANDARD | STANDARD | STANDARD | STANDARD | STANDARD | STANDARD |
| 6 | MAX10A | 10A | 10A | STANDARD | STANDARD | STANDARD | STANDARD | STANDARD | STANDARD | STANDARD |
| 7 | AGED PERSON | AGED | 20A | STANDARD+5 | STANDARD−100 | STANDARD | STANDARD | STANDARD | STANDARD | STANDARD |
| 8 | SUPPER ENERGY SAVING | SUPPER ENERGY SAVING | 20A | STANDARD−10 | STANDARD+200 | STANDARD+200 | STANDARD | STANDARD | STANDARD | STANDARD |
| 9 | EMPTY | – | – | – | – | – | – | – | – | – |
| 10 | EMPTY | – | – | – | – | – | – | – | – | – |
| 11 | EMPTY | – | – | – | – | – | – | – | – | – |
| 12 | EMPTY | – | – | – | – | – | – | – | – | – |

AIR-CONDITIONING APPARATUS

BACKGROUND OF THE INVENTION

1. Field of the Invention

The present invention relates to an air-conditioning apparatus, being able to receive and download operation control information (including, operation program and operation control data) from an outside through a network.

2. Description of Prior Art

Conventionally, for example, in Japanese Patent Laying-Open No. Hei 4-103949 (1992) <Document 1> was described an air-conditioner, which receives variable data necessary for controlling the air conditioner from an outside of an air conditioning controller circuit, thereby executing an air conditioning control program upon the basis of the variable data, which is newly memorized therein. Also, for example, in Japanese Patent Laying-Open No. Hei 10-232044 (1998) <Document 2> was described that an air conditioning mode, which is written or made up by using a personal computer, corresponding to a personal taste or preference of an individual, is received by a remote controller of the air-conditioner, and is transmitted from the remote controller to the main body of the air conditioner, thereby operating the air-conditioner, and also that an air-conditioning can be set independently for each of the individuals through a personal-setting key(s) of the remote controller.

However, in those documents, no consideration was taken into the connection of the air-conditioner with a common telephone network (a public network; including wired and wireless telephone circuits), so as to download the operation control program and/or the operation control data thereof to the air-conditioner. For this reason, they have drawbacks, such as, (1) operability of the air conditioner after the download operation; (2) operability during the download operation; and (3) malfunction in relation with the network, etc.

SUMMARY OF THE INVENTION

A first object, according to the present invention, is to provide an air-conditioner having good operability after the download operation.

A second object, according to the present invention, is to provide an air-conditioner having good operability during the download operation.

A third object, according to the present invention, is to provide an air-conditioner having a function of inhibiting such the malfunction in relation with the network.

The first object mentioned above, according to the present invention, is accomplished by an air-conditioning apparatus, having: a compressor; an outdoor heat exchanger; an indoor heat exchanger; an outdoor fan; an indoor fan; and a controller for controlling said compressor, said outdoor fan and said indoor fan, wherein, said controller comprises: a transmission portion to be connected with a network for sending and receiving information; a memory means for memorizing operation control information received through said transmission portion; a remote controller transmission portion for transmitting information between a remote controller; and means for operating the air-conditioner under an operation mode upon basis of said operation control information from a remote controller.

Also, the first object mentioned above, according to the present invention, is accomplished by an air-conditioning apparatus, having: a compressor; an outdoor heat exchanger; an indoor heat exchanger; an outdoor fan; an indoor fan; and a controller for controlling said compressor, said outdoor fan and said indoor fan, wherein, said controller comprises: a transmission portion to be connected with a network for sending and receiving information; a memory means for memorizing operation control information received through said transmission portion; a remote controller transmission portion for transmitting information between a remote controller; and a memory portion for memorizing a part of said operation control information in said remote controller.

The second object mentioned above, according to the present invention, is accomplished by an air-conditioning apparatus, having: a compressor; an outdoor heat exchanger; an indoor heat exchanger; an outdoor fan; an indoor fan; and a controller for controlling said compressor, said outdoor fan and said indoor fan, wherein, said controller comprises: a transmission portion to be connected with a network for sending and receiving information; a memory means for memorizing operation control information received through said transmission portion; a remote controller transmission portion for transmitting information between a remote controller; and a download means for taking said operation control information via said network into said memory portion through conduction on said remote controller.

And, the third object mentioned above, according to the present invention, is accomplished by an air-conditioning apparatus, having: a compressor; an outdoor heat exchanger; an indoor heat exchanger; an outdoor fan; an indoor fan; and a controller for controlling said compressor, said outdoor fan and said indoor fan, wherein, said controller comprises: a transmission portion to be connected with a network for sending and receiving information; a memory means for memorizing operation control information received through said transmission portion; a remote controller transmission portion for transmitting information between a remote controller; and means for inhibiting transmission of information between said network.

BRIEF DESCRIPTION OF THE DRAWINGS

Those and other features, objects and advantages of the present invention will become more apparent from the following description when taken in conjunction with the accompanying drawings wherein:

FIG. 4 is a view for explaining about first download information in the embodiment according to the present invention;

FIG. 7 is a view for explaining about more detailed download information, in the embodiment according to the present invention;

DETAILED DESCRIPTION OF PREFERRED EMBODIMENT

Figure 1:
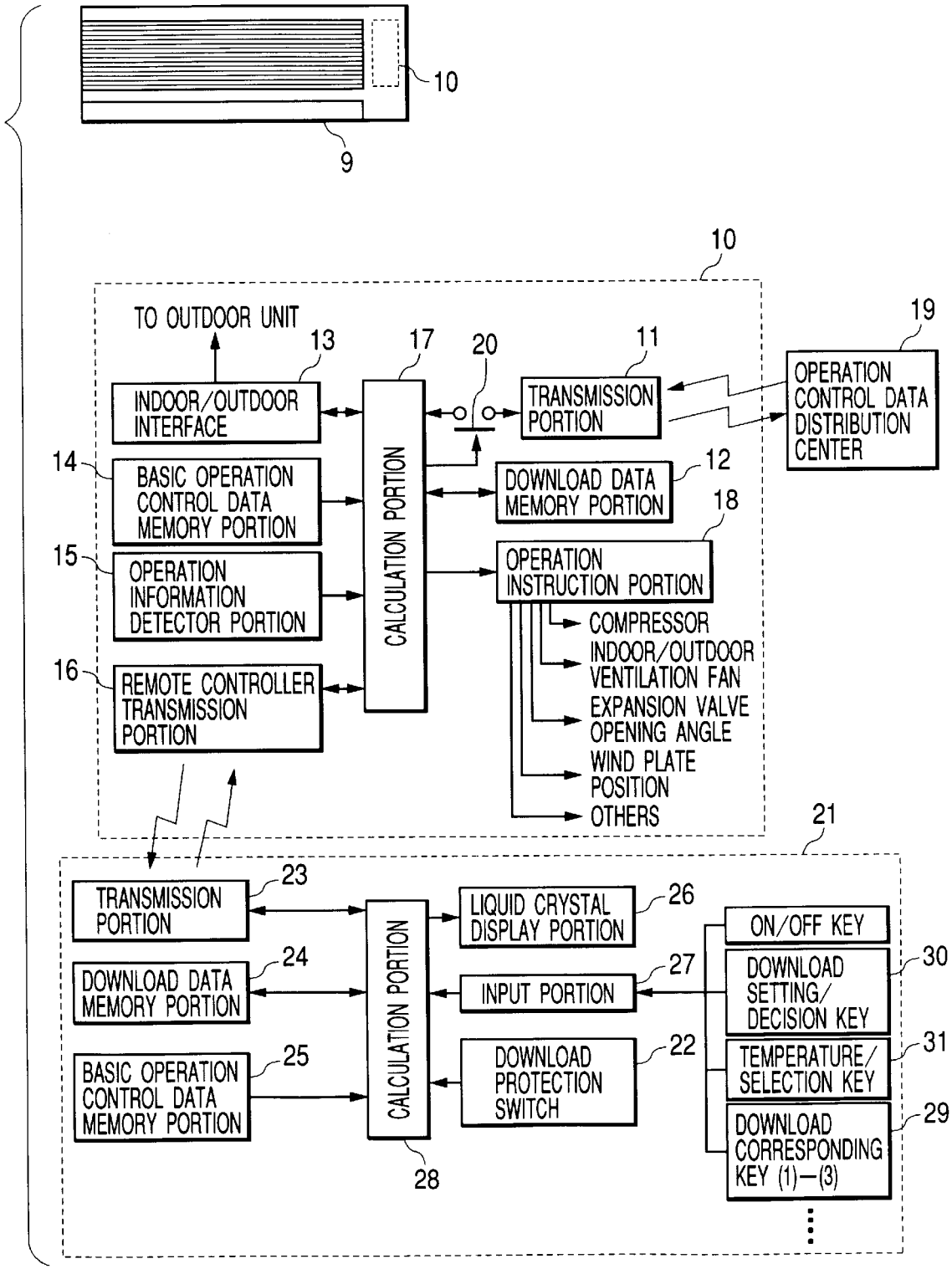
FIG. 1 is a view for explaining the structure of a control system according to a first embodiment of the present invention.
Figure 2:
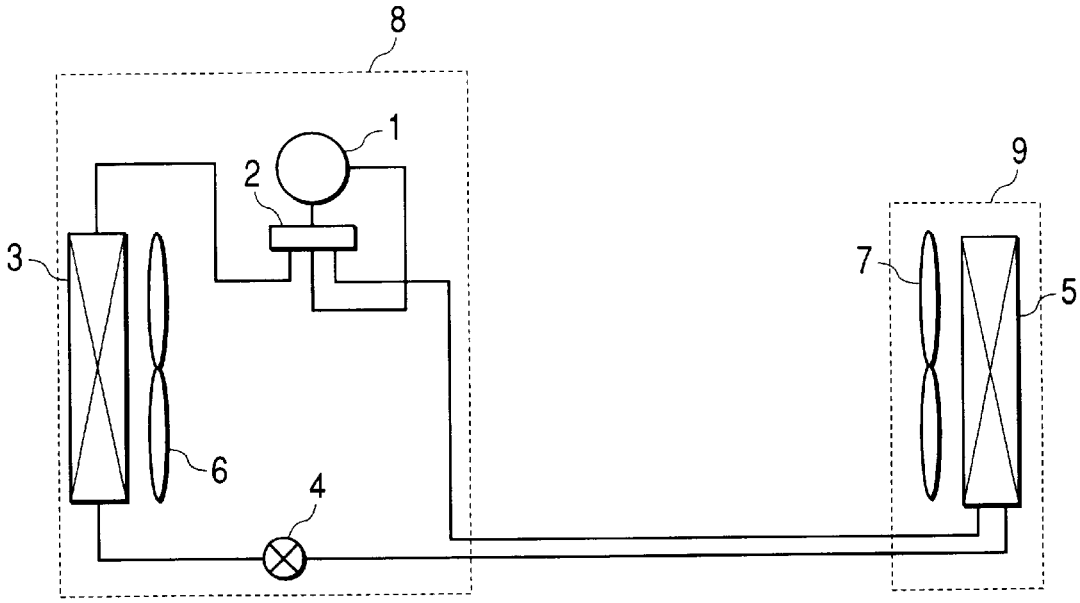
FIG. 2 is a view for showing the structure of a refrigerating cycle in the first embodiment according to the present invention.

Hereinafter, embodiments according to the present invention will be fully explained by referring to the attached drawings. A compressor 1, being located within an outdoor unit 8 and made up with a compression mechanism portion and a motor portion, is connected with, through a four-way valve 2 for exchanging coolant flow-passage and coolant pipes. An outdoor heat exchanger 3 is connected at one end to the four-way valve 2, while the other end thereof to an electromotive expansion valve 4 of depression variable-type. An indoor heat exchanger 5 is located within an indoor unit 9, and one end thereof is connected to the electromotive expansion valve 4, while the other end thereof to the four-way valve 2 through the coolant pipe. Connecting those in sequentially through pipes builds up a refrigerating cycle. Further, within the outdoor unit 8 is provided an outdoor fan 6, while within the indoor unit 9 an interior or indoor fan 7.

In the refrigerating cycle constructed in the manner mentioned above, for example in the case under a cooling operation mode, the coolant circulates in such way: first, the coolant at high temperature and high pressure, being compressed in the compressor 1, passes through the four-way valve 2 and is condensed through irradiation of heat into air by the outdoor fan 6 in the outdoor heat exchanger 3, and then is decompressed down to low pressure in the electromotive expansion valve 4. While in the indoor heat exchanger, the coolant absorbs heat from air by the indoor fan 7, so as to evaporate, and turns back to the compressor 1, again.

And, for example, when the rotation speed of the compressor 1 comes up, then an amount of circulating coolant, therefore a cooling capacity (or a heating capacity) rises up. However, the higher the rotation of the compressor, the larger the mechanical loss in sliding portions within the compressor, therefore the noises thereof comes up.

Also, for example, when the rotation speed of the outdoor fan 6 or the indoor fan 7 comes up, the heat exchange can be conducted even if the temperature difference is small between the coolant and the air, therefore it is possible to reduce the motive power of the compressor. However, when the fan is operated at high rotation speed, the noises also rise up.

Also, for example, when applying current into the motor in an inside of the compressor, so that the motor will not rotate, the compressor is heated up due to the heat generation of the motor. Therefore, if doing this when the air-conditioner stops in a period of midwinter or the like, the performance when starting heating operation can be improved, thereby obtaining a progress on comfortableness. However, for the heating of the compressor, the electric power consumption is increased up.

As was mentioned above, this kind of the air-conditioner has a characteristic that the noises and the electric power consumption, etc., rise up when trying to improve the efficiency and the comfortableness.

FIG. 1 is a view for showing the structure of the control system of this refrigerating cycle. In an inside of the indoor unit 9 is provided a controller 10. A transmission portion 11 has a function of sending out a signal requiring operation control information to an outside and also the function of receiving the operation control information from an outside (hereinafter, being called by "download"), through a network (thus, the common telephone network (i.e., the public network, including wired and wireless telephone circuits)). A download data memory portion 12 is made up with a re-writable memory means for memorizing the operation control information downloaded. An indoor interface 13 has a function of conducting information transmission between the indoor unit 9 and the outdoor unit 8. A basic operation control information memory portion 14 has a table, into which data are stored, such as, the rotation speed of the compressor, an instruction value for the indoor and outdoor fans, etc. An operation information detector portion 15 inputs sensor outputs form various portions, and thereby detects the operation information, such as, the temperature, the rotation speeds of the various parts, etc. A remote controller transmission portion 16 has a function of transmitting an operation instruction or the like, generated from the remote controller operated by a user. A calculation portion 17 is a calculation means for executing various calculation or procession upon the basis of the data, such as, those of the transmission portion 11, of the download data memory portion 12, the indoor interface 13, of the basic operation control information memory portion 14, of the operation information detector portion 15, and of the remote controller transmission portion 16, mentioned above. An operation instruction portion 18 is for outputting operation instructions to various parts or elements upon the basis of the calculation results, and in particular, it outputs the rotation speed of the compressor, the rotation speed of the indoor and outdoor fans, an opening angle of the electromotive expansion valve, and the position of an indoor wind plate, in the form of control instructions. Those are stored within the controller 10.

Also, an operation control data distribution center 19 is connected with the transmission portion 11 through the common telephone network. Upon the basis of the signal requiring operation control data, being sent from the transmission portion 11, the operation control data of the air conditioner for use of download, which is stored in a server within the operation control data distribution center 19, is sent to the transmission portion 11.

Figure 3:
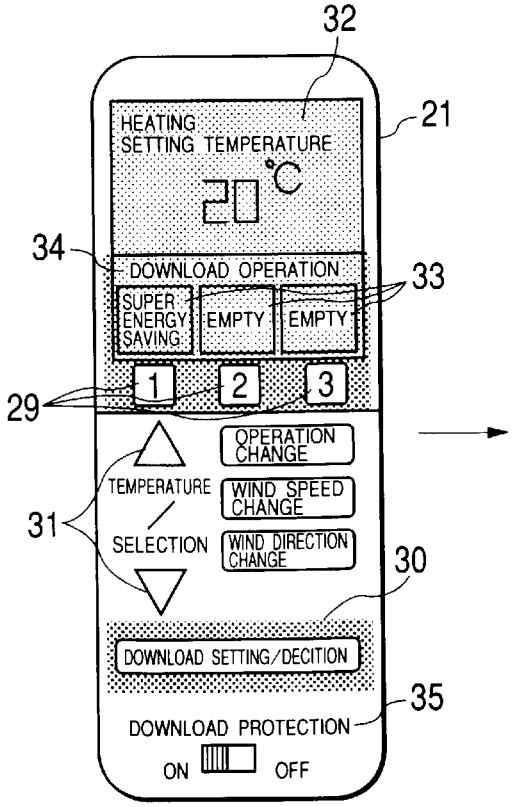
FIG. 3 is a view for explaining about a remote controller according to the embodiment of the present invention.

The remote controller 12 is for transmitting information or the like, upon setting of operation mode made by the user at her/his desire, between the remote controller transmission portion 16. FIG. 3 shows an outlook of this remote controller 21, wherein the same reference numerals are given to the same or similar elements thereof. Within an inside thereof, the remote controller 21 is built up with a transmission portion 23 for conducting communication with the controller 10 (i.e., the remote controller transmission portion 16); a download data memory portion 24 within the remote controller; a basic operation control data memory portion 25; a liquid crystal display portion 26; an input portion, being made up with keys and sliding switches; and a calculation portion 28; and it further comprises three (3) keys (indicated by a reference numeral 29 in the FIG. 3) corresponding to download operation modes, through which the user can select the operation mode(s) that becomes newly operable after the download of the operation control from the operation control data distribution center 19. Further, a reference numeral 30 is a download setting/decision key to be used when conducting the download, and a reference numeral 31 a temperature/selection key to be used when setting the temperature and also when conducting the download.

On the liquid crystal display portion 32 of the remote controller 21, in addition to the common display, such as, the operation mode, the temperature and/or moisture setting, actual temperature and/or moisture, etc., the modes being operable through the download is/are displayed in the download operation mode display portion 33, corresponding to the download operation mode corresponding keys 29, and is so structured as to display the fact when the download is completed.

Into the download data memory portion 14 within the remote controller 21 is stored only the data necessary for the instruction from the remote controller 21 among the operation control data within the download data memory portion 12, i.e., the minimal data that enable the start of the operation by the operation control data downloaded. Also, there is provided a download protection switch 22 for selecting the download operation to be able or not (unable).

Explanation will be given on the operation of such the air-conditioner apparatus, as is structured in the manner mentioned above. First, the user obtains an Instruction and/or user's Manual, and such operation mode information shown as shown in FIG. 4, through the Internet or a facsimile, etc. And, she/he performs the download operation by conducting the operation on the remote controller, which is shown in the flowchart of FIG. 4 and as shown in FIG. 6.

The reason of making such the operation mode information displayed on an information source, such as the documents, etc., other than on the air-conditioner itself, lies in that the user cannot understand what the operation is, if being displayed by an abbreviation, such as "MAX 15A" as the operation mode on the display portion of the remote controller for the air-conditioner, as shown in the FIG. 4. Therefore, the detailed explanation on each of the operation modes is needed, necessarily, but the display of such the detailed explanation on a small window makes difficult to be seen by the user, and also on a reason that further functions must be provided or installed on the remote controller and into the indoor unit for the data transmission.

Next, explanation will be made on the download operation, by referring to FIGS. 5 and 6 attached. The user turns the download protection switch 35 on the remote controller 21 into OFF. With this, within the controller 10, the download switch 22 is brought in contact with via the remote controller transmission portion 16 and the calculation portion 17, thereby conducting or communicating between the calculation portion 16 and the transmission portion 17, i.e., in the condition being able to start the download (see the step 1 in FIG. 5, and (1) in FIG. 6).

Figure 5:
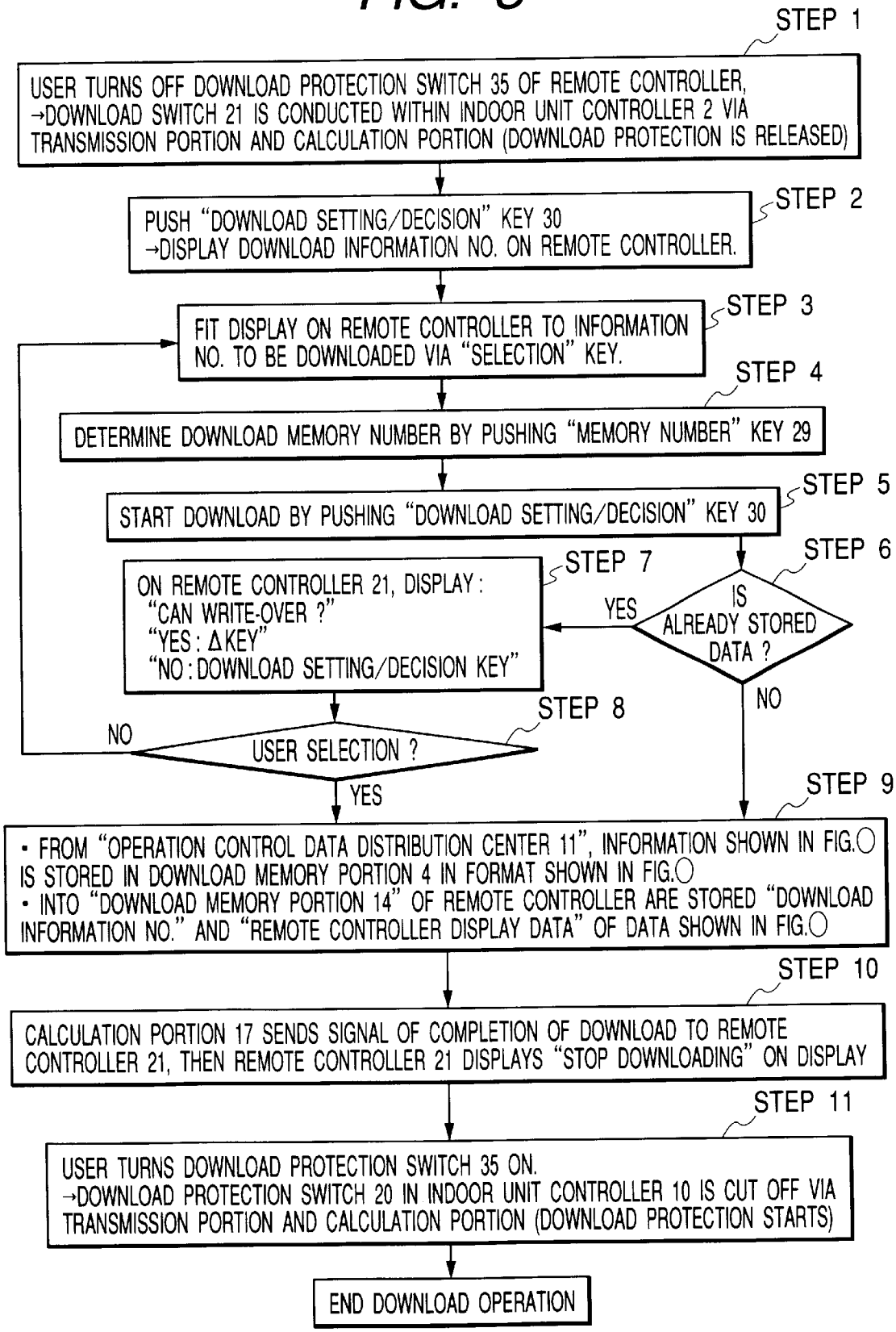
FIG. 5 is a flowchart for showing the control in the embodiment according to the present invention.
Figure 6:
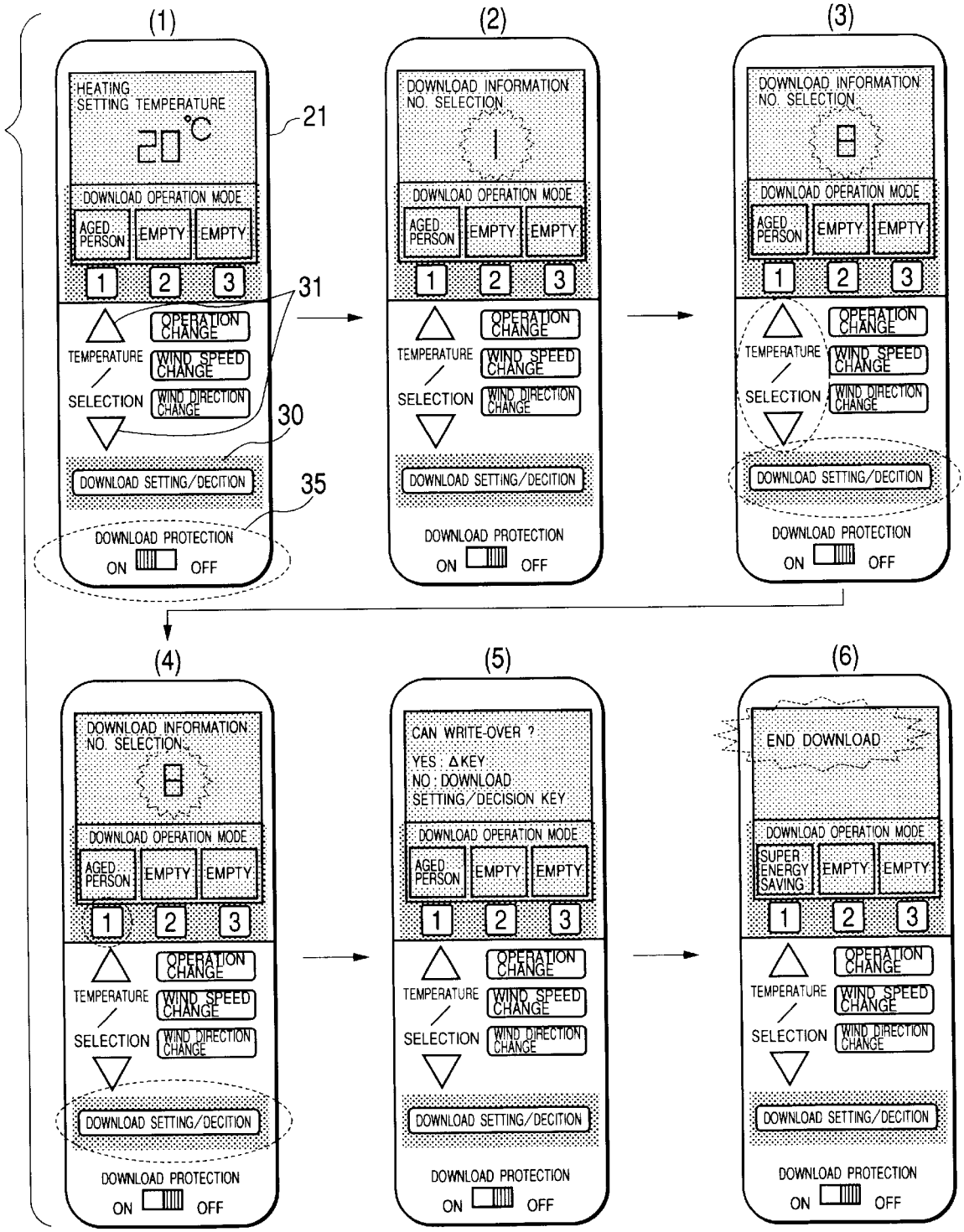
FIG. 6 is a view for explaining about various operations on the remote controller according to the embodiment of the present invention.

Next, the user pushes the "DOWNLOAD SETTING/DECISION" key 30 down, thereby displaying download information No. on the remote controller (see the step 2 in FIG. 5, and (2) in FIG. 6).

Then, upon the basis of the operation mode information shown in the FIG. 4, which was obtained in advance, she/he operates the temperature/setting key 31 on the remote controller 21, so as to make the display corresponding to the No. of the operation mode, on which she/he wishes to conduct downloading (see the step 3 in FIG. 5, and (3) in FIG. 6). For instance, when she/he wishes to select the "SUPER ENERGY SAVING", the operation should be made so as to appears "8" on the display.

She/he pushes down the key 29 of the operation number (i.e., the memory number, and "1" is selected in FIG. 5 (4)) where she/he wishes to do downloading (see the step 4 in FIG. 5, and (4) in FIG. 6), and further pushes down the "DOWNLOAD SETTING/DECISION" key 30, thereby determining the download memory number (see the step 5 in FIG. 5, and (4) in FIG. 6).

Herein, if the stored data remains within the memory, into which she/he wish to download the data (see the step 6 in FIG. 5), the controller 10 displays "CAN WRITE-OVER?", "YES: ΔKEY" and "NO: DOWNLOAD SETTING/DECISION KEY" on the liquid crystal display portion 32 on the remote controller 21 (see the step 7 in FIG. 5 and (5) in FIG. 6). Responding to this, if the user selects "NO", the process turns back to the step 3, while it advances to the next step 9 if selecting "YES" (see the step 8 in FIG. 5).

Figure 8:
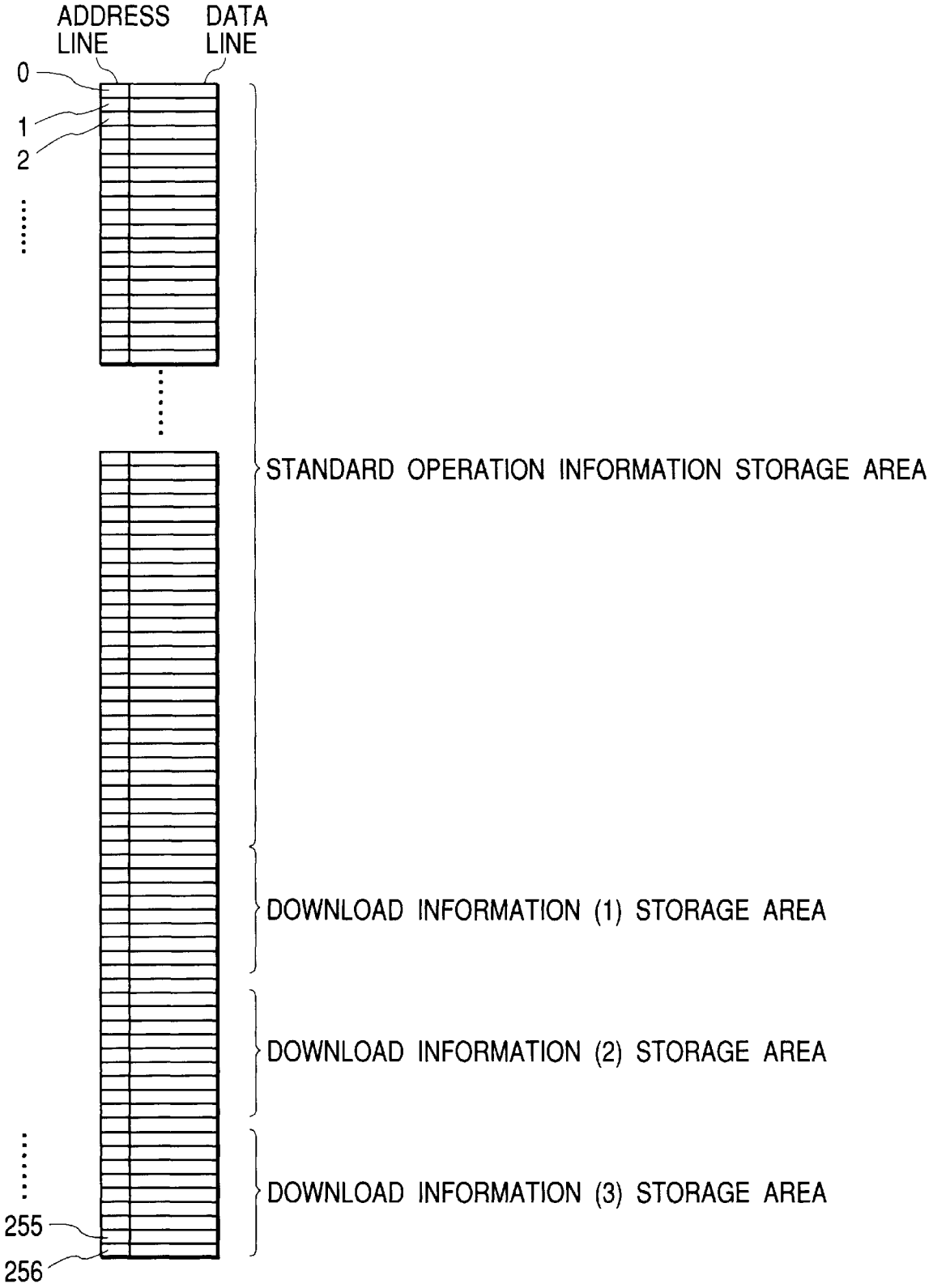
FIG. 8 is a view for showing the format of control data, in the embodiment according to the present invention.

When being allowed to be write-over by selecting "YES", the controller 10 downloads various operation control information, such as, "MAXIMUM CURRENT", "COMPRESSOR PRE-HEAT TEMPERATURE", "INDOOR FAN ROTATION SPEED", "OUTDOOR FAN ROTATION SPEED", "COMPRESSOR ROTATION SPEED", "COMPRESSOR ACCELERATION RATE", "DEFROST DECISION HEAT EXCHANGER TEMPERATURE" and "DEFROST STOP HEAT EXCHANGER TEMPERATURE", corresponding to "DOWNLOAD INFORMATION NO.", "OPERATION MODE" and "REMOTE CONTROLLER DISPLAY", as shown in FIG. 7, and stores them into "DOWNLOAD INFORMATION (1) STORAGE AREA" of the download data memory portion 12 within the controller 10 of the indoor unit. FIG. 8 shows a format for the data storage of them. A data line is stored corresponding to an address line, and this data line has "STANDARD OPERATION INFORMATION STORAGE AREA", "DOWNLOAD INFORMATION (1) STORAGE AREA", "DOWNLOAD INFORMATION (2) STORAGE AREA" and "DOWNLOAD INFORMATION (3) STORAGE AREA", and the control information mentioned previously is stored in this "DOWNLOAD INFORMATION (1) STORAGE AREA".

Figure 9:
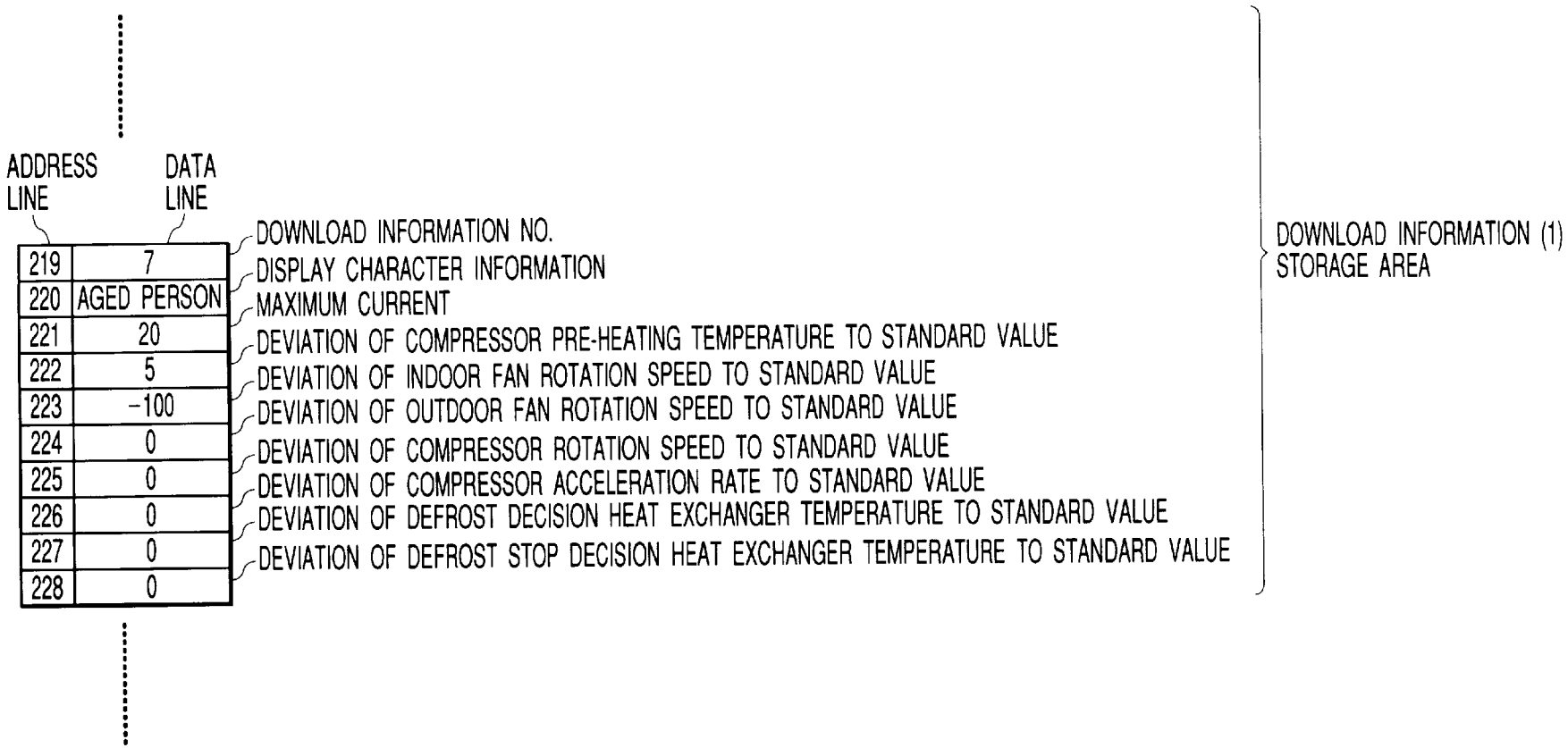
FIG. 9 is a view for showing the format of data downloaded, in the embodiment according to the present invention.

The data format in the "DOWNLOAD INFORMATION (1) STORAGE AREA" includes deviation and magnification, etc., with respect to the common operation mode, correspondingly, as shown in FIG. 9. Further, into the download data memory portion 24 within the remote controller are stored only the "DOWNLOAD INFORMATION NO." and "REMOTE CONTROLLER DISPLAY" among of them (see the step 9).

During the download operation, a message, "UNDER DOWNLOADING" is displayed on the liquid crystal display portion 26. When the downloading is completed, on the liquid crystal display portion 32 are displayed a message, "END DOWNLOADING", and a message, "SUPER ENERGY SAVING" of the operation mode, which is newly available (see (6) in FIG. 6). In this instance, the messages displayed on the remote controller 21 are the "REMOTE CONTROLLER DISPLAY" data that are downloaded into the download data memory portion within the remote controller, previously.

And, the user turns the download protection switch 35 into ON, again, thereby completing a series of operations of the downloading (see the step 11).

After those download operations, for example, when wishing to operate the air-conditioner under the operation mode, such as, "SUPER ENERGY SAVING", which was downloaded by her/him, the user pushes down the "DOWNLOAD CORRESPONDING KEY" 29 within the remote controller 21, during the operation of the air-conditioner or when it starts the operation, thereby the air-conditioner starts the "SUPER POWER SAVING" operation.

When being downloaded to be stored corresponding to the download mode operation corresponding keys 29 pushed down, each of the download data is memorized into the download data memory portion 12, and at the same time, the data mentioned above is memorized also into the download data memory portion 24 within the remote controller. And, as was mentioned in the above, through operation upon the download mode operation corresponding keys 29, the air-conditioner is possible under any one of the operation modes.

For example, when the user selects the first one, i.e., "SUPER ENERGY SAVING" operation mode among the download mode operation corresponding keys 29, the calculation portion 28 of the remote controller outputs the data, which relates to the download No. corresponding to the operation mode selected from the download memory portion 24, through the transmission portion 23 and the remote controller transmission portion 16, to the calculation portion 17 of the indoor unit. The calculation portion 17 of the indoor unit takes out the operation control information corresponding to the operation mode selected, upon the basis of the download information No. transmitted, by referring to the download data memory portion 12 of the indoor unit. And, it generates control instructions by combining it together with the information from the basic operation control information memory portion 14 and the operation information detector portion 15, thereby controlling the rotation speed of the compressor (not shown in the figure), the rotation speed of the indoor fan 7, the rotation speed of the outdoor fan 6, the decompression amount in the decompression apparatus 4, the position of the indoor wind plate (not shown in the figure), etc., through the operation instruction portion 18, so as to carry out the "SUPER POWER SAVING" operation.

In more details, since the "SUPER ENERGY SAVING" operation decreased down the pre-heating temperature of the compressor by 10° C., it is possible to lower the electric power/energy consumption at that time, and also since it increases up the rotation speeds of the indoor fan and of the outdoor fan by 20 turns /min., therefore it is possible to obtain an decrease in the condensation temperature, as well as, an increase in the evaporation temperature, thereby achieving reduction in the electric power consumption.

By the way, when "AGED PERSON" is selected, since the controller 10 shortens the starting time with respect to the operation mode normally operated, so as to setting the pre-heating temperature of compressor at, such as, a standard value +5, the rotation speed of the indoor fan comes down to be less by 100 turns/min., thereby bringing about a comfortable operation condition for the aged person(s) through reducing in an amount of wind hitting directly on the her/his body.

As was mentioned in the above, since the remote controller is able to display the operation mode(s) which it downloads from an outside through the network, and also since it has the key(s) corresponding to operation mode(s), anyone can operate the air-conditioner under the operation mode downloaded, with ease and certainty. Also, the download data memory portion is located in both the controller 10 within the indoor unit and the remote controller 21, it is enough for the remote controller 21 to memorize the operation control information which is necessary for it, therefore it has no necessity to be large in sizes thereof, and can prevent from being lowered down in the operability thereof.

Also, according to the present embodiment, since the remote controller 21 comprises the download protection switch 35, through which the download operating of the operation control information can be selected to be operable or inoperable, the air-conditioner can be brought into the condition of being inoperable to conduct the download, by means of the download protection switch 22, therefore it is possible to prevent it from receiving unnecessary operation mode through erroneous operation(s), and also from flowing out the user's information to the operation control data distribution center 19, etc., when it does not conduct downloading. Also, according to the present invention, though the protection switch 22 is provided on the remote controller 21, however it may be also provided on the indoor unit 9 and/or on the outdoor unit 8, and especially in this case, the remote controller 21 can be constructed to be simple in the structure, thereby obtaining light-weighting, as well as, improvement on the usability.

Also, according to the present embodiment, the remote controller 21 is constructed, so that it can display that on the liquid crystal display plate 26 when it has completed the downloading, but it may be also possible to provide a download end or stop display lamp on the indoor machine in the place thereof. In this instance, also the remote controller 21 can be made simple in the structured, thereby obtaining the light-weight.

However, it is explained that the operation for starting the download is conducted by a key for exclusive use thereof, in the present embodiment, however it may be possible that the operation can be conducted by combining plural number of keys. In this instance, it is possible to reduce possibility of conducting unnecessary download.

As was mentioned in the above, since the remote controller is so constructed as to be able to display: the operation information downloaded; an indication for operation of the air-conditioner under the downloaded operation mode; and an indication for the download operation, therefore, anyone can operate the air-conditioner under the downloaded operation mode, and/or carry out the download, easily and certainly. Further, since it is only necessary for the remote controller to memorize at least the necessary operation control information therein, the capacity of the memory means, into which that operation control information is stored, can be made small, thereby obtaining the remote controller in small sizes. Further, since the function of informing the completion or end of downloading, it is possible to protect the air-conditioner from the malfunction, which will be caused by a fact that the user sometimes tries to operate the air-conditioner during the operation of downloading. Furthermore, because of the provision of the download start key, it is possible to conduct the download operation, easily without using other equipments. Moreover, since the air-conditioner can be brought into the condition of being unable to conduct the download by means of the protection switch, it is possible to protect the air-conditioner from receiving the unnecessary operation mode and from flowing out the user's information to the operation control data distribution center, etc., when it does not conduct the downloading, through such the erroneous operation(s).

As was fully mentioned in the above, according to the present invention, it is possible to provide an air-conditioner having good operability thereof after downloading.

Also, according to the present invention, it is possible to provide an air-conditioner having good operability during downloading.

Further, according to the present invention, it is possible to provide an air-conditioner having a function of protecting from the erroneous operation relating the network.

While we have shown and described several embodiments in accordance with our invention, it should be understood that the disclosed embodiments are susceptible of changes and modifications without departing from the scope of the invention. Therefore, we do not intend to be bound by the details shown and described herein but intend to cover all such changes and modifications falling within the ambit of the appended claims.

What is claimed is:

1. An air-conditioning apparatus, having:

a compressor; an outdoor heat exchanger;

an indoor heat exchanger;

an outdoor fan;

an indoor fan; and a controller for controlling said compressor, said outdoor fan and said indoor fan, wherein, said controller comprises:

a transmission portion to be connected with a network for sending and receiving information;

a memory means for memorizing operation control information received through said transmission portion;

a remote controller transmission portion for transmitting information between a remote controller; and means for operating the air-conditioner under an operation mode upon basis of said operation control information from a remote controller.

2. An air-conditioning apparatus, as defined in the claim 1, wherein said remote controller comprises a display portion for displaying the operation mode which is made operable by said operation control information.

3. An air-conditioning apparatus, as defined in the claim 1, further comprising means for informing a user of completion when receiving of said operation control information is completed.

4. An air-conditioning apparatus, having:

a compressor;

an outdoor heat exchanger;

an indoor heat exchanger;

an outdoor fan;

an indoor fan; and a controller for controlling said compressor, said outdoor fan and said indoor fan, wherein, said controller comprises:

a transmission portion to be connected with a network for sending and receiving information;

a memory means for memorizing operation control information received through said transmission portion;

a remote controller transmission portion for transmitting information between a remote controller; and a memory portion for memorizing a part of said operation control information in said remote controller.

5. An air-conditioning apparatus, as defined in the claim 4, wherein the part of said operation control information memorized in said remote controller contains at least data number and a content to be displayed on said remote controller corresponding to said data number.

6. An air-conditioning apparatus, having:

a compressor;

an outdoor heat exchanger; an indoor heat exchanger;

an outdoor fan;

an indoor fan; and a controller for controlling said compressor, said outdoor fan and said indoor fan, wherein, said controller comprises:

a transmission portion to be connected with a network for sending and receiving information;

a memory means for memorizing operation control information received through said transmission portion;

a remote controller transmission portion for transmitting information between a remote controller; and a download means for taking said operation control information via said network into said memory portion through conduction on said remote controller.

7. An air-conditioning apparatus, as defined in the claim 6, wherein said download means provided in said remote controller has a means for inputting an operation mode for conducting the download, and a means for selecting a space for memorizing the information downloaded.

8. An air-conditioning apparatus, as defined in the claim 6, further comprising plural numbers of buttons, and means for displaying the operation mode contained in said operation control information downloaded corresponding to said buttons.

9. An air-conditioning apparatus, having:

a compressor;

an outdoor heat exchanger;

an indoor heat exchanger;

an outdoor fan;

an indoor fan; and a controller for controlling said compressor, said outdoor fan and said indoor fan, wherein, said controller comprises:

a transmission portion to be connected with a network for sending and receiving information;

a memory means for memorizing operation control information received through said transmission portion;

a remote controller transmission portion for transmitting information between a remote controller; and means for inhibiting transmission of information between said network.

* * * * *